US006609942B1

(12) United States Patent
Cole et al.

(10) Patent No.: US 6,609,942 B1
(45) Date of Patent: Aug. 26, 2003

(54) SPHERICAL TOY BALL BAGS

(75) Inventors: Jeffrey C. Cole, Arvada, CO (US); Kenneth H. Fleck, Littleton, CO (US)

(73) Assignee: Accord Publishing LTD, Denver, CO (US)

( * ) Notice: Subject to any disclaimer, the term of this patent is extended or adjusted under 35 U.S.C. 154(b) by 0 days.

(21) Appl. No.: 09/705,042

(22) Filed: Nov. 2, 2000

Related U.S. Application Data

(63) Continuation-in-part of application No. 09/373,162, filed on Aug. 12, 1999, now Pat. No. 6,149,201, which is a continuation of application No. 08/902,452, filed on Jul. 29, 1997, now Pat. No. 5,941,570

(60) Provisional application No. 60/026,447, filed on Sep. 18, 1996.

(51) Int. Cl.[7] ..... A63H 33/00

(52) U.S. Cl. ..... 446/77; 446/392; 206/542; 150/103

(58) Field of Search ..... 206/542; 150/457, 150/103; 446/71–77, 80, 8, 9, 343, 97, 99–100, 392; 434/393, 395; 40/580; D3/201, 234–236, 216; D7/709–710; 190/103, 107

(56) References Cited

U.S. PATENT DOCUMENTS

| | | | | | |
|---|---|---|---|---|---|
| 1,028,921 | A | | 6/1912 | Wagner | |
| 1,033,576 | A | | 7/1912 | Garman | |
| 1,981,333 | A | | 11/1934 | Schavoir | 46/40 |
| 2,085,414 | A | * | 9/1937 | Cavanagh | |
| 2,489,240 | A | | 11/1949 | Meyer | 46/34 |
| 2,538,085 | A | | 1/1951 | Cotton | 35/8 |
| 3,162,977 | A | * | 12/1964 | Elischer | |
| 3,734,365 | A | * | 5/1973 | Sprecker | 224/8 R |
| 3,918,180 | A | | 11/1975 | Chamberlin | |
| 4,174,059 | A | * | 11/1979 | Maunder | 224/209 |
| 4,458,899 | A | * | 7/1984 | Kanno et al. | 273/143 |
| 4,828,531 | A | * | 5/1989 | Kuhn | 446/392 |
| 4,941,603 | A | * | 7/1990 | Creamer et al. | 224/148 |
| 4,993,845 | A | * | 2/1991 | Faltynek | 383/40 |
| D315,444 | S | * | 3/1991 | Maddocks | D3/66 |
| D324,307 | S | * | 3/1992 | Lin | D3/66 |
| 5,255,834 | A | * | 10/1993 | Bendersky | 224/209 |
| 5,337,913 | A | * | 8/1994 | Fukuda | 220/326 |
| 5,472,279 | A | * | 12/1995 | Lin | 383/2 |
| 5,718,336 | A | * | 2/1998 | Haarlander | 206/542 |
| 5,864,973 | A | | 2/1999 | Cole | |
| 5,897,042 | A | * | 4/1999 | Sims | 224/576 |
| 5,915,729 | A | | 6/1999 | Vap | |
| 5,941,570 | A | | 8/1999 | Cole et al. | |
| 6,220,318 | B1 | * | 4/2001 | Pinti | 150/103 |
| D448,923 | S | * | 10/2001 | Willingham et al. | D3/216 |

OTHER PUBLICATIONS

Title: Eve Spy a Panda! Author: Jean Hwang 1995 Publisher: Threehouse Children's Books Limited.

* cited by examiner

*Primary Examiner*—Derris H. Banks
*Assistant Examiner*—Jamila Williams
(74) *Attorney, Agent, or Firm*—Rick Martin; Patent Law Offices of Rick Martin, P.C.

(57) ABSTRACT

The present invention is a toy for amusement. The toy has a panel having one or more spherical toy balls, commonly known as "floating eyeballs," Jet Balls™ or Glide Balls™, affixed to the panel in a bulging manner. The panel may have graphic depictions including human, insect, animal, or creature-like facial features on both its front and back surfaces. Alternately, one or both sides of the panel can be an interactive surface, whereby the user creates his own artwork around the eyes. The panel can be hingedly connected to a base container to create a toy box, or a lunch box, or a lunch bag, or backpack such that when the panel is turned over or opened, a new panel bearing different features or the interactive surface appears. The panel and spherical toy ball(s) together make an entertaining three-dimensional representation that can be controlled by the user to create a visual effect in which the spherical toy ball(s) move about in a manner similar to human-like eye movement. Some box embodiments show creature contours coordinated with the "wiggly" eyeballs to create shapes such as an alligator.

13 Claims, 16 Drawing Sheets

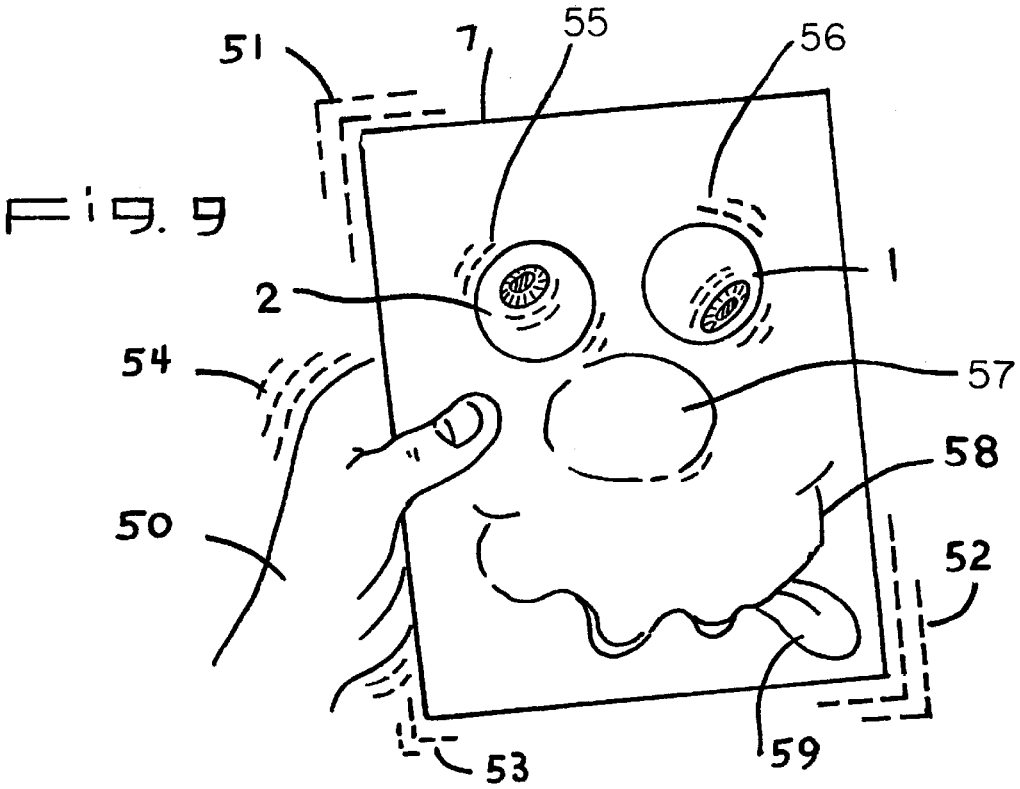
Fig. 9
Fig. 10a
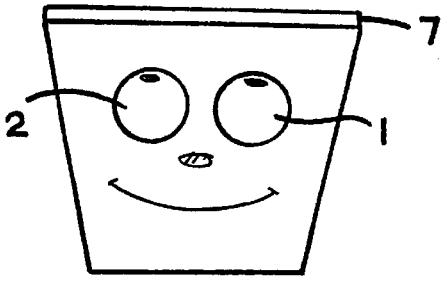
Fig. 10b
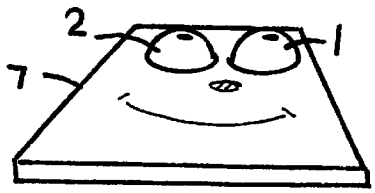
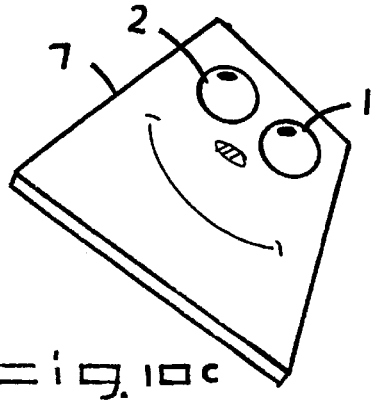
Fig. 10c
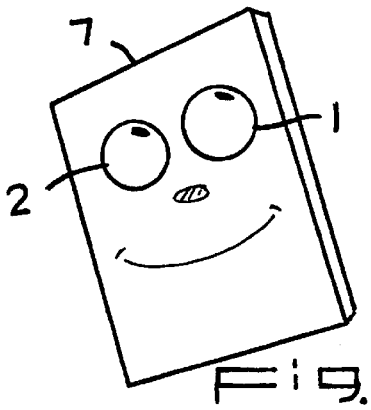
Fig. 10d
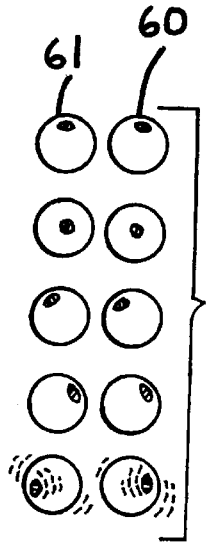
Fig. 10e

SPHERICAL TOY BALL BAGS

CROSS-REFERENCE TO RELATED APPLICATION

This application is a continuation in part application claiming the benefits of U.S. application Ser. No. 09/373,162 filed Aug. 12, 1999 Now U.S. Pat. No. 6,149,201, which is a continuation of U.S. application Ser. No. 08/902,452 filed Jul. 29, 1997 and issued as U.S. Pat. No. 5,941,570 on Aug. 24, 1999 which claimed the benefits of provisional application Ser. No. 60/026,447 filed Sep. 18, 1996.

FIELD OF THE INVENTION

The present invention relates to using known spherical toy balls, commonly known as "floating eyeballs," Jet Balls™ or Glide Balls™ in a panel or panels to create an amusing and entertaining three-dimensional display on a lunch box, storage box, lunch bag, backpack and the like.

BACKGROUND OF INVENTION

Known in the art are "floating eyeballs" comprised of an eyeball-decorated (i.e. pupil, iris, blood vessels, etc.) inner sphere encased and floating within a larger clear outer sphere. The inner and outer spheres are separated by a clear liquid. The eyeball-decorated inner sphere is weighted such that the pupil automatically rotates upwards no matter which direction the sphere is rotated. See U.S. Pat. No. 1,981,333 incorporated herein by reference. It is not known to combine the floating eyeball with a hinged panel, thereby forming a storage container having a 3D animation panel. The present invention creates a toy that in one embodiment creates a plurality of facial expressions by combining said panels and one or more pair of floating eyeballs. It is known in the art that any floating objects including belly buttons, other body parts, floating bugs, and/or graphic designs would all be equivalent to the best mode depiction herein of floating eyeballs.

SUMMARY OF THE INVENTION

The present invention is a toy for amusement. The toy is comprised of a panel with one or more spherical toy balls, commonly known as the above noted "floating eyeballs." The panel can bear features resembling a human, insect, animal or other creature-like facial expression. The panel can bear facial features on both its front and back surfaces, or it may have an interactive surface such as a dry-erase board, sticker board, magnetic board, art board etc. hereafter called "interactive surface". The panel can be hingedly connected to a container such as a lunch bag such that when the connected panel is flipped over, a rear panel surface bearing different artwork, facial features or interactive surface appears. The panel and floating eyeballs together make an entertaining three-dimensional character representation that can be controlled by the user to create an animated effect called "Eyeball Animation®." "Eyeball Animation®" describes a visual effect in which the eyeball-decorated inner sphere moves about the clear plastic outer sphere in a manner similar to human-like eye movement. Unique to this toy is the ability to utilize both sides (front and rear) of the floating eyeballs unlike U.S. Pat. No. 5,941,570, which only uses a front side in a doll.

The primary aspect of the present invention is to affix a floating eyeball to a panel so as to create a variety of entertaining and amusing facial expressions and scenes via the combination, and affix the panel to a lunch bag, lunch box crayon box, backpack or the like.

Another aspect of the present invention is to allow the user to create additional entertaining and amusing scenes by shaking or tilting the panel causing the floating eyeballs to move in different directions thereby providing the artwork surrounding the "floating eyeballs" varied visual affects.

Another aspect of the present invention provides the user a variety of entertaining and amusing facial expressions or scenes quickly and conveniently. The present invention attaches the primary panel to the closing flap of a lunch bag with a different printed scene on one side and/or an interactive surface (dry erase board) on the reverse side of said panel. Since the floating eyeballs automatically rotate upwards, the user has quick and convenient access to additional facial expressions and scenes by turning the panel over and creating different artwork around the floating eyeballs.

Another aspect of the present invention is to permit the user to create his own entertaining three dimensional representations by introducing a blank panel around the floating eyeballs affixed to the primary panel such that the user may draw, paint or otherwise place an image of his own creation on the blank panel, such as a note from mom to remind the child to drink his milk, complete with a drawing of a cow.

The preferred embodiment Doodle Lunch Bags™ with Dry Erase Board have special features including:

- The only Eyeball Animation® Lunch Bag available
- Eyeball Animation® easy wipe, Dry Erase Board (8"×8")
- Dry Erase Marker
- Vivid artwork on front & back of bag
- 20-page doodle idea book
- Made from a durable nylon backed, non-staining, easy wash material
- Water resistant 70 D PVC outer surface
- Reinforced stress points for added strength
- Rugged PVC non-abrasive bottom for everyday drops and drags
- Large expanding food compartment
- Quick access velcro closure on main compartment, separates and seals food
- Quick cinch velcro buckle
- Quick slot marker holder
- Padded carry handle
- Mesh accessory pocket for eraser, additional markers and knick knacks
- High density close cell foam with reflective barrier
- Revolutionary Freeze Tech™ Thermo Reflective insulation—keeps foods hot and cold for up to 10 hours Eyeball Animation® and Eyeball Animated® are registered trademarks of Accord Publishing LTD.

Currently there are three styles to choose from.

UPC: 74626607-0004 (DOG)

UPC: 74626607-0011 (CAT)

UPC: 74626607-0028 (DINOSAUR)

Current Suggested Retail: $12.95

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 9 is a top plan view showing the user shaking the panel to create a visual display of dancing eyeballs.

FIGS. 10*a*, 10*b*, 10*c*, 10*d*, 10*e* are various top perspective views showing the floating eyeballs automatically rotating upwards when panels are tilted at different angles or directions.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
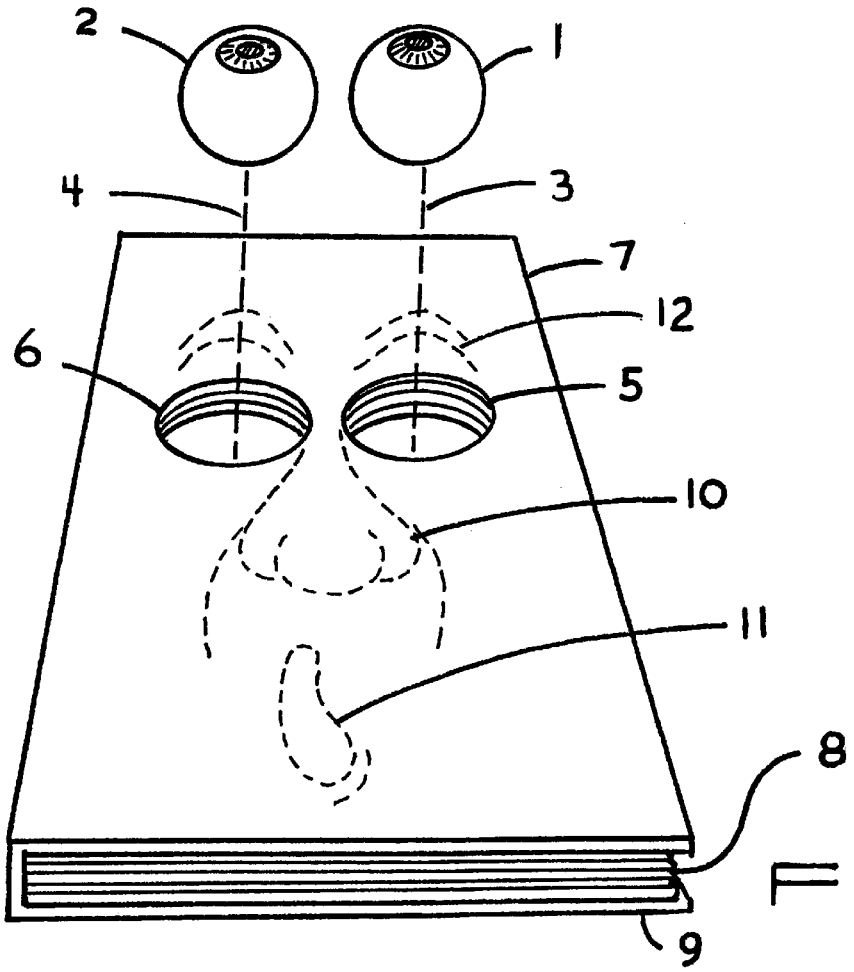
FIG. 1 is a top perspective view of the front panel, said panel being a book, card cover, or two-surfaced (front and back) panel showing the eyeholes and the placement of the floating eyeballs in the panel.
Figure 2:
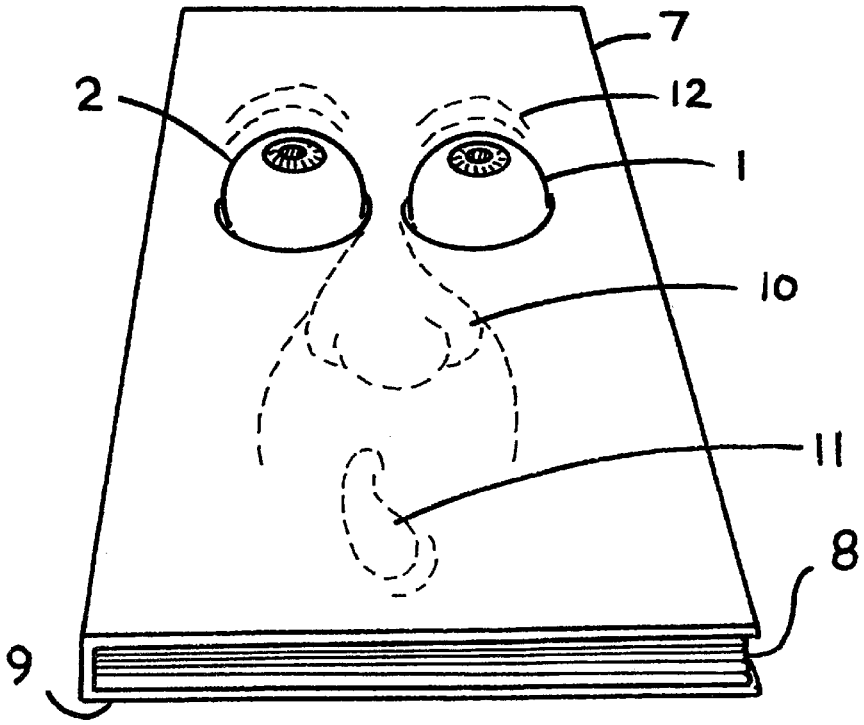
FIG. 2 is a top perspective of the front panel, said panel being a book or card cover, i.e., two-surfaced (front and back) panel showing the floating eyeballs embedded in the panel.

FIGS. 1, 2 are top perspective views of the invention and show the embedding of the floating eyeballs 1, 2 into the panel 7. The panel 7 can be made of varied materials including cardboard, plastic and the like. Each floating eyeball 1, 2 is mounted onto the panel 7 either directly to the panel surface or preferably embedded into the eye holes 5, 6. See the dotted lines 3 and 4 between the eyeballs and the eye holes in the panel. The floating eyeballs bulge outwardly from both the front and back sides of the panel. See top and side profile views in FIGS. 7, 8. This can be accomplished by cutting or punching out circular holes 5 and 6 the size of each eyeball 1 and 2 from the panel 7 and then inserting and affixing the eyeballs 1 and 2 to the panel 7 by any number of methods including a permanent lock or glue system. See FIG. 2 for a perspective front and bottom view of the floating eyeballs embedded into the panel. Also, included in FIG. 1, 2 are depictions of inner pages 8, back cover 9 and facial features 10.

Figure 6:
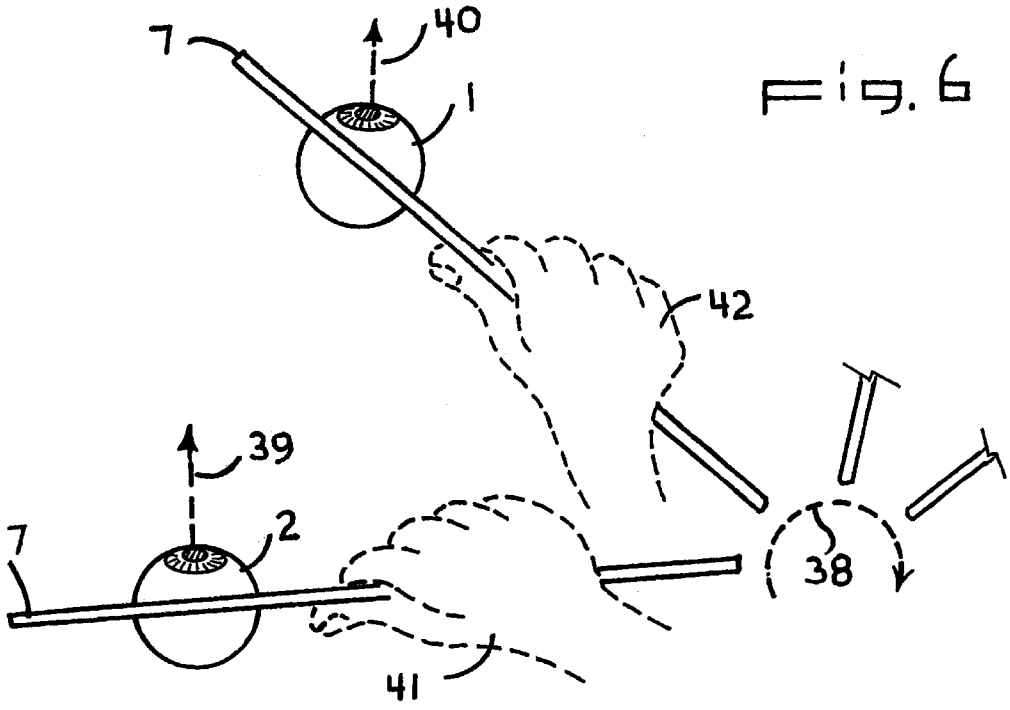
FIG. 6 is a side profile view of the panel being tilted by the user in order to show the floating eyeballs automatic rotation upwards no matter what angle or direction the panel is tilted.
Figure 7:
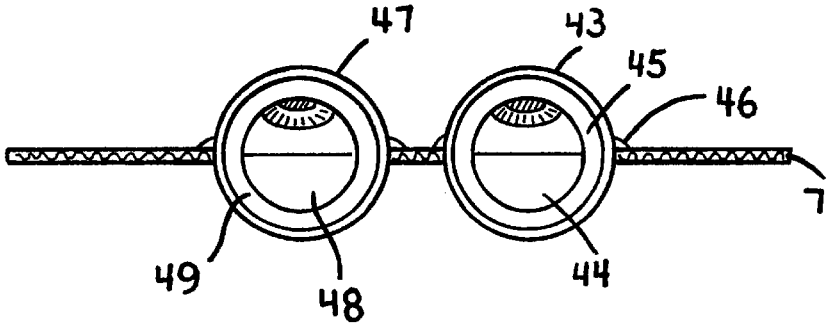
FIG. 7 is a top profile view of the panel showing the floating eyeballs bulging out of both the front and back of the panel.
Figure 8:
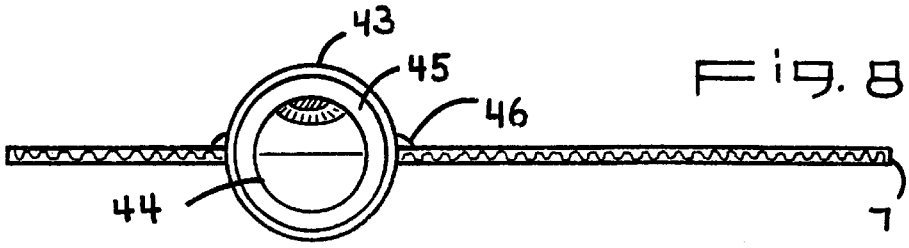
FIG. 8 is a side profile view of the panel showing the floating eyeball bulging out of both the front and back of the panel.

FIGS. 7, 8 show the floating eyeballs comprised of an eyeball-decorated inner sphere 44, 48 encased and floating in a clear plastic outer sphere 43, 47 filled with a clear liquid 44, 48. The eyeball-decorated inner sphere 44 is weighted such that the pupil automatically rotates upwards no matter which direction the outer sphere 43 is rotated. The outer sphere 43 is affixed to the panel 7 by any number of methods including a permanent lock or glue system 46. FIG. 6 depicts the upwards rotation of the floating eyeball 1 when the outer sphere, as affixed to the panel 7, is tilted away from horizontal. The floating eyeball 1 in this example, is an existing toy that is available in the current retail marketplace.

Figure 3:
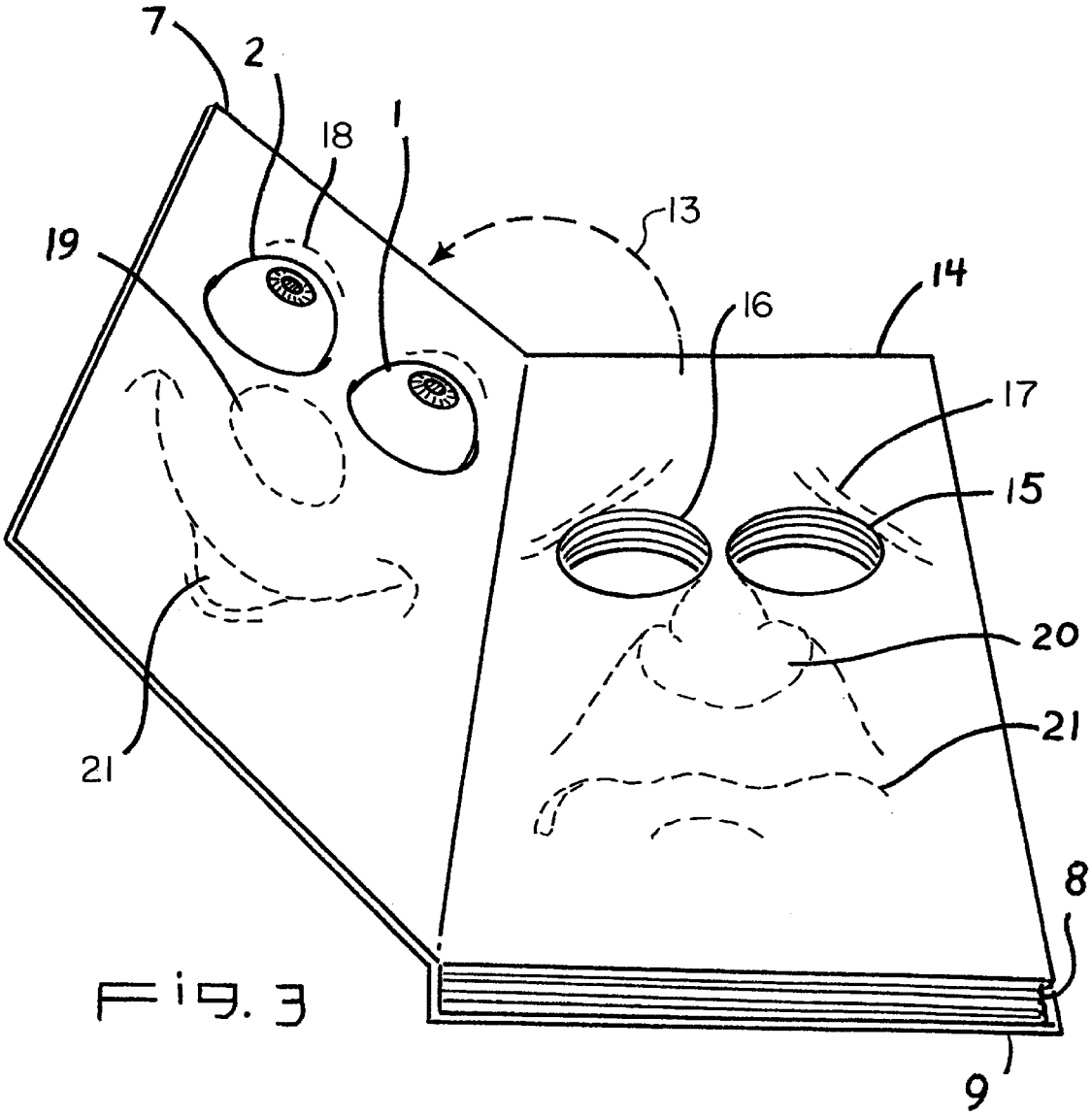
FIG. 3 is a top perspective view of the book or card with the front panel flipped open to reveal the back of the front panel and inner pages or panels of the book, card, or back side of a two-surfaced panel.

Referring next to FIG. 3 the floating eyeballs. 1,2 are embedded and affixed to a durable book or card cover or two-surfaced (front and back) panel 7 such that the cover substitutes for the panel 7 described above. The panel or the book or card cover 7 can bear facial features on both its front and back sides. The facial features 16, 17, 18 can be placed around the floating eyeballs 1, 2 (eyeholes 4, 5) to create human, insect, animal or other creature-like facial images.

Figure 4:
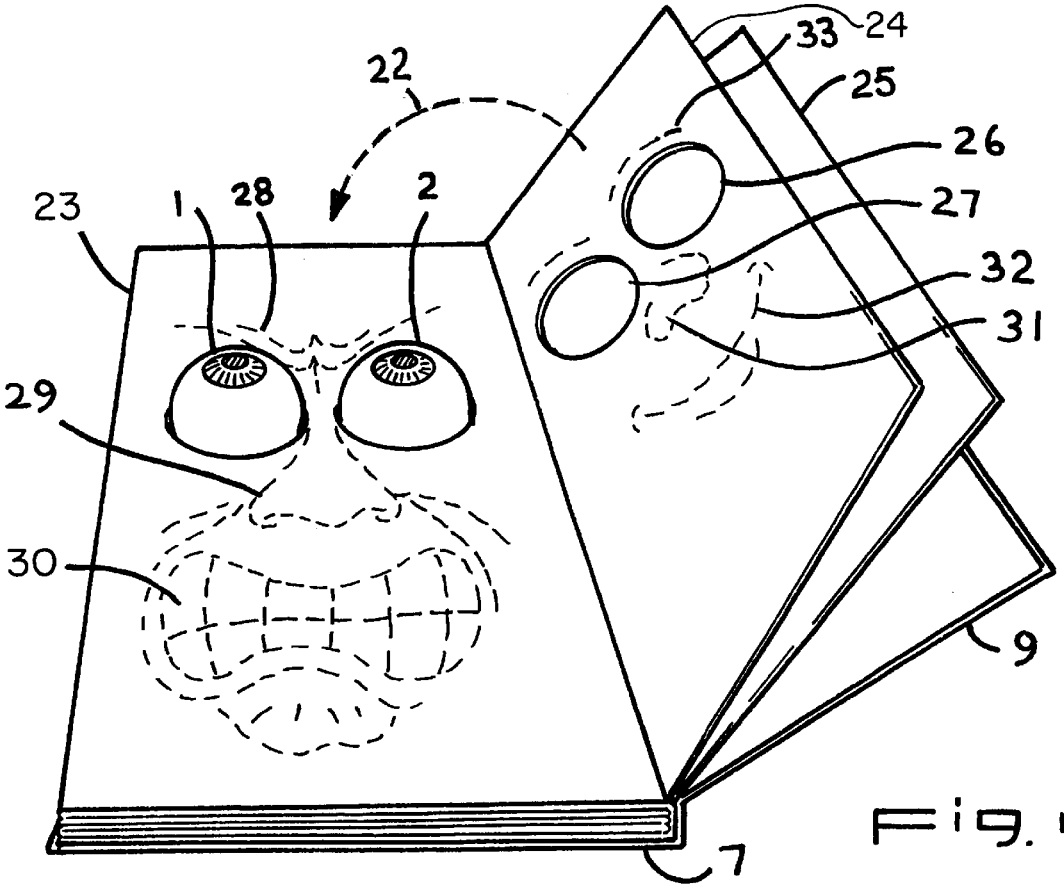
FIG. 4 is a top perspective view of the book with the inner pages or panels being flipped.
Figure 5:
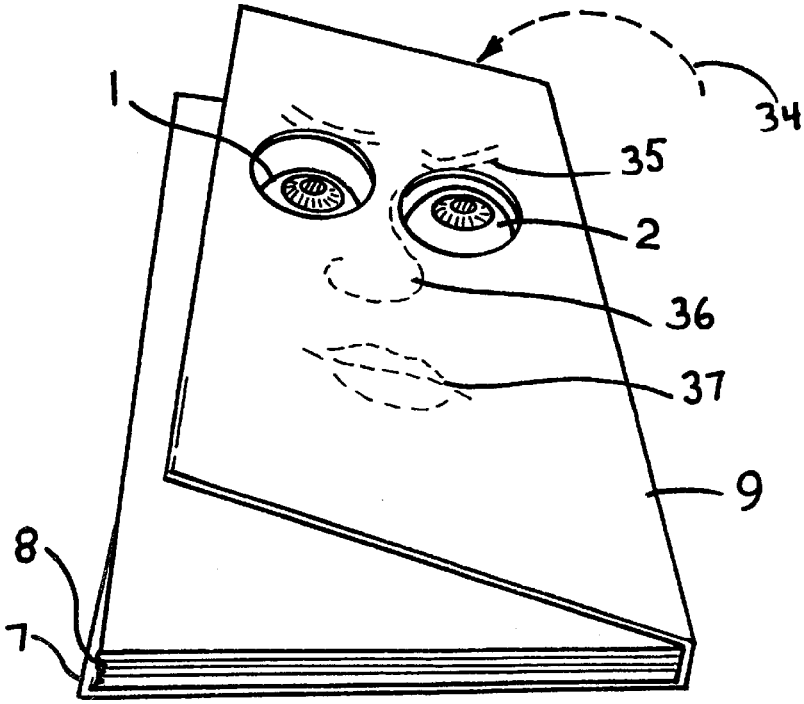
FIG. 5 is a top perspective of the back panel, said panel being a book, card cover, or two-surfaced (front and back) panel.

Additional embodiments shown in FIGS. 4, 5 entail the introduction of numerous additional panels 24, 25 bearing alternative facial features such as 31, 32, 33 over and onto a previous panel 23 containing the affixed floating eyeballs 1, 27. Each additional panel contains a circular eyehole 26, 27 for each floating eyeball 1, 2, permitting the user to quickly and conveniently place the additional panel over and onto the previous panel in order to create a different facial expression or scene. Each additional panel may bear alternative facial features on both its front and back sides.

FIG. 9 is a top profile view of the panel 7 being shaken (represented by 51, 52, 53,) by the user 50 to cause the eyeball-decorated inner spheres 1, 2, to move about (represented by 56, 57) creating an entertaining and amusing visual effect.

Referring to FIGS. 10*a*–10*e*, a series of top panel views is shown. The panel 7 with the affixed floating eyeballs 1, 2 may be tilted in a controlled manner in various directions and angles by the user in order to create the illusion of human-like eye movement. The eyeball-decorated inner sphere rotates about upwards automatically as the panel is tilted in any direction and angle. The panel with the affixed floating eyeballs may also be tilted in a controlled manner into fixed positions by the user in order to create the illusion that floating eyeballs are glancing in one particular direction or as if the floating eyeballs are looking at something on the panel.

Figure 11:
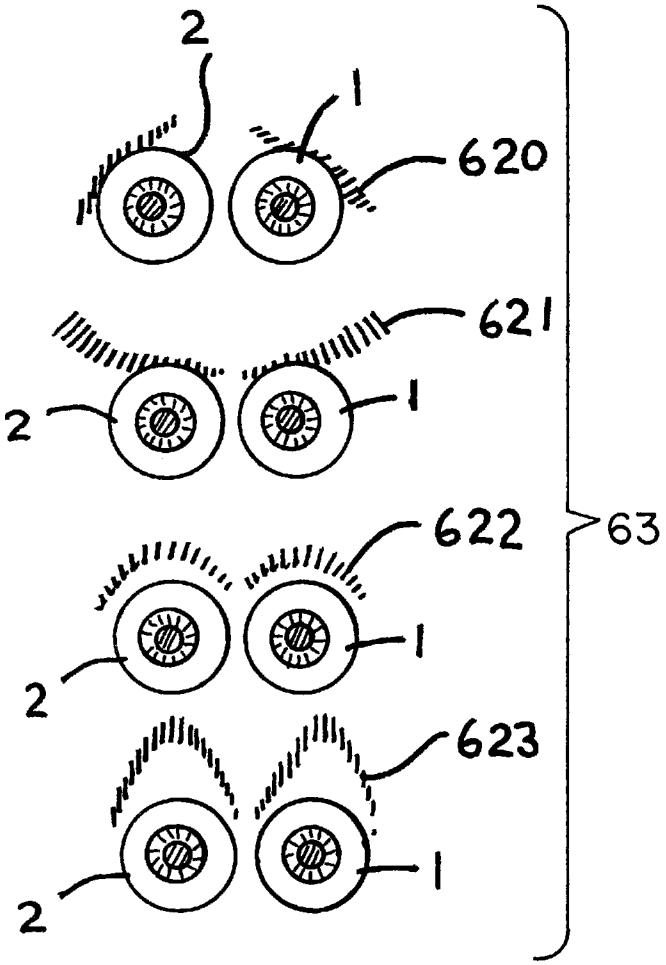
FIG. 11 is a variety of examples of facial expressions the user may choose to draw, paint or otherwise place around the floating eyeballs on blank panels.
Figure 13:
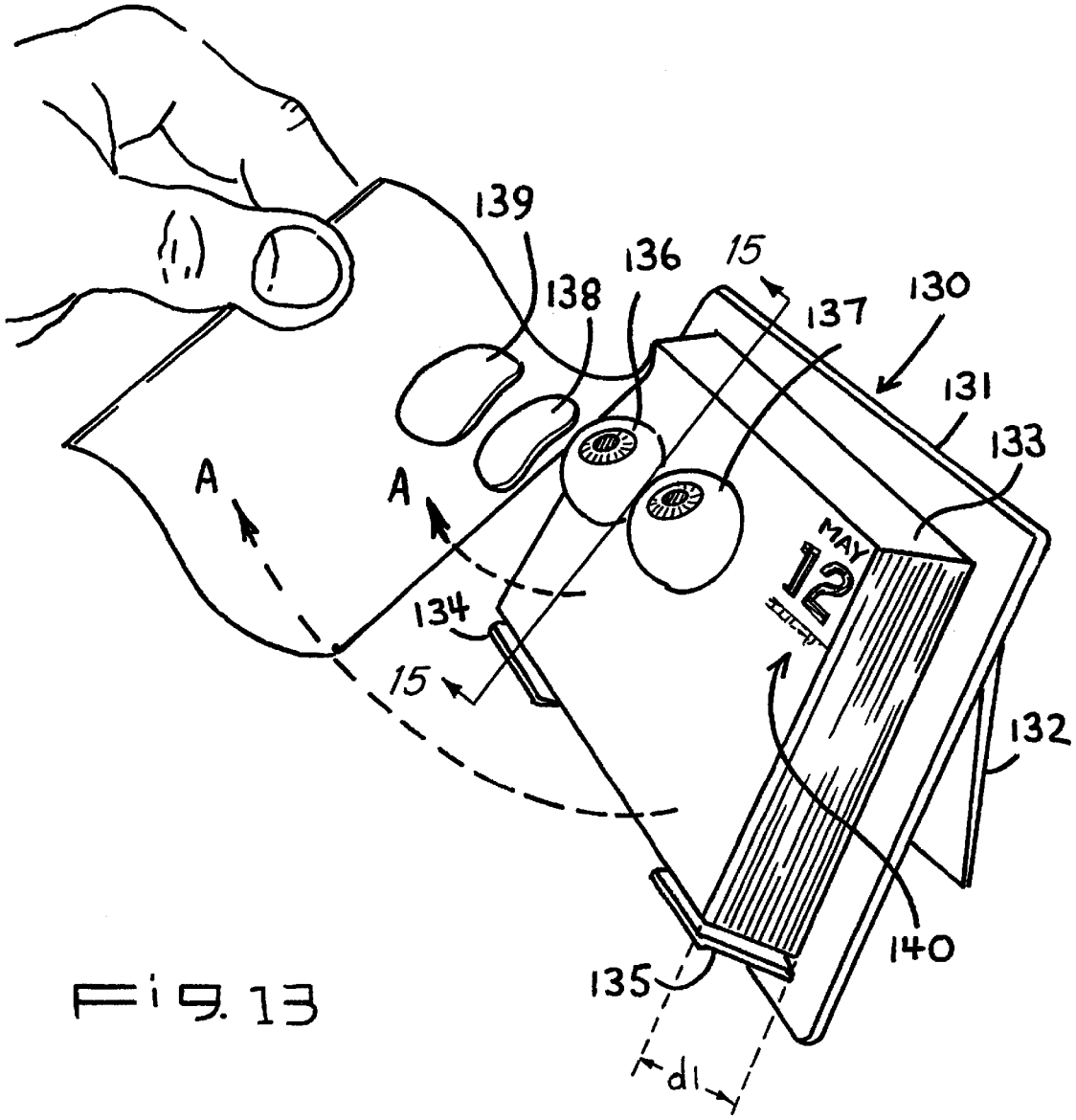
FIG. 13 is a top perspective view of an alternate embodiment, a floating eyeball calendar.
Figure 14:
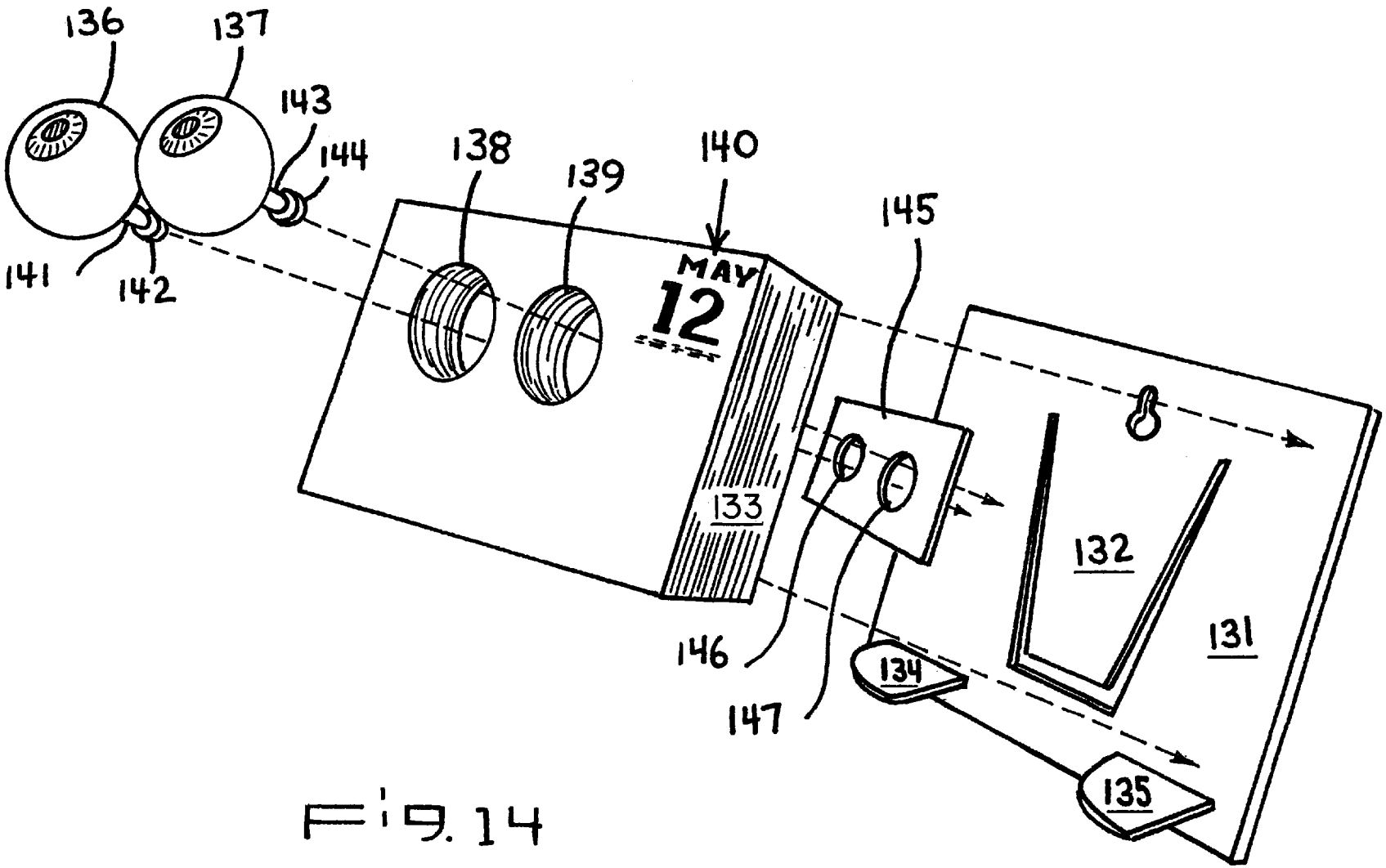
FIG. 14 is an exploded view of the calendar embodiment of FIG. 13.

FIG. 11 shows examples of user added eyebrows 620, 621, 622, 623 to a blank panel 63 by the user.

Figure 12:
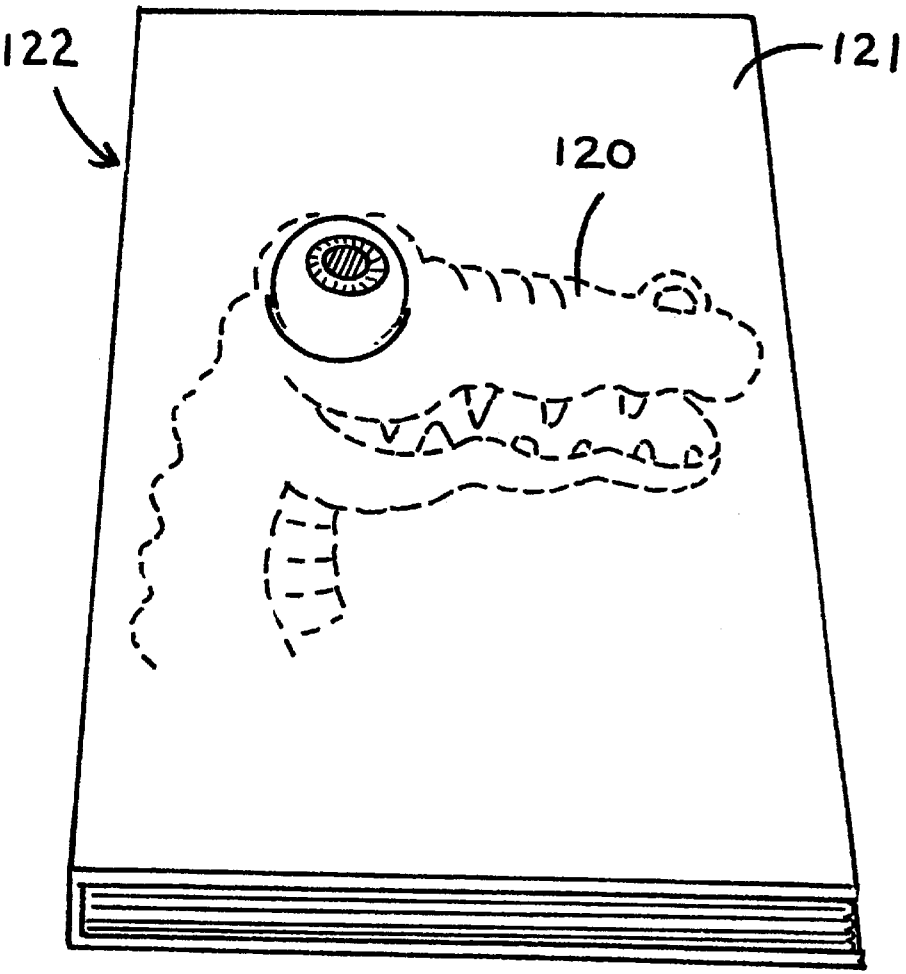
FIG. 12 is a perspective view of a single eyeball embodiment.

FIG. 12 shows a one eyeball embodiment having a crocodile caricature 120 on a book cover 121 for a book 122.

To summarize, the invention may be used to entertain and amuse the user in any of the following manners:

1. The primary panel with the affixed floating eyeballs may be shaken by the user, in order to cause the eyeball decorated inner sphere to move about creating an entertaining and amusing visual effect. See FIG. 9.

2. The panel with the affixed floating eyeballs may be tilted in a controlled manner in various directions and angles by the user in order to create the illusion of human-like eye movement. The eyeball-decorated inner sphere automatically rotates upwards as the panel is tilted in any direction and angle. See FIGS. 10*a*–10*e*.

3. The panel with the affixed floating eyeballs may be tilted in a controlled manner into fixed positions by the user in order to create the illusion that floating eyeballs are glancing in one particular direction or as if the floating eyeballs are looking at something on the panel. See FIGS. 10*a*–10*e*.

4. The panel with the affixed floating eyeballs may be turned over or reversed by the user to reveal the back side of the panel in order to create the illusion that the floating eyeballs have flipped to the back side of the panel when in reality, the panel and not the floating eyeballs have been flipped. See FIG. 3.

5. Additional panels with eyeholes bearing alternative facial features can quickly and conveniently be placed by the user over the existing panel with the affixed floating eyeballs in order to create different facial expressions. See FIG. 4.

6. The user can create their own facial features by drawing, painting, or placing removable stickers or magnets on blank "interactive" panels with eyeholes. See FIG. 11.

7. The interactive panels can be painted or drawn to represent various facial expressions, such as happy or sad faces.

8. A single floating eyeball can be affixed to the panel in order to create a profile facial image as opposed to the frontal facial image created by the affixation of two floating eyeballs to the panel. See FIG. 12.

9. The panels may be marked with written instructions to show the user how to direct the floating eyeballs to look in various directions, or other users instruction such as doodle ideas.

Referring next to FIGS. 13, 14, 15, and 16 a calendar 130 has a backplate 131 and a stand 132. The calendar pages 133 are supported by ledges 134, 135. The floating eyeballs 136, 137 protrude through holes 138, 139 in the pages 133. Each page 133 has alpha-numeric characters 140 to indicate the date. Each day a page 133 is removed as indicated by arrows "A" to provide the proper date to the user.

During use, the distance $d_1$ will decrease. In order to maintain the entertaining sight of eyeballs protruding through the uppermost page, the eyeballs 136, 137 must periodically be adjusted to move back towards the backplate 131. An embodiment not shown would size the eyeballs to protrude all the way through the pad without adjustment. To accomplish this task, a tab 145 having holes 146, 147 is provided which removably engages the fasteners 142, 144 of the floating eyeballs 136, 137. Legs 141, 143 affix the fasteners 142, 144 to the floating eyeballs 136, 137.

Figure 15:
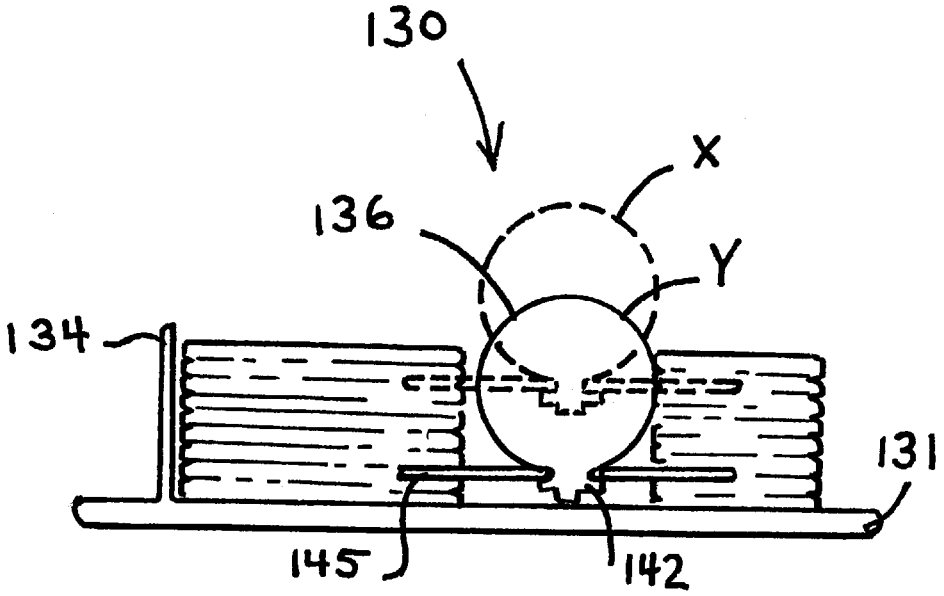
FIG. 15 is a sectional view taken along line 15—15 of FIG. 13 showing the positioning of the support tab for the floating eyeballs.
Figure 16:
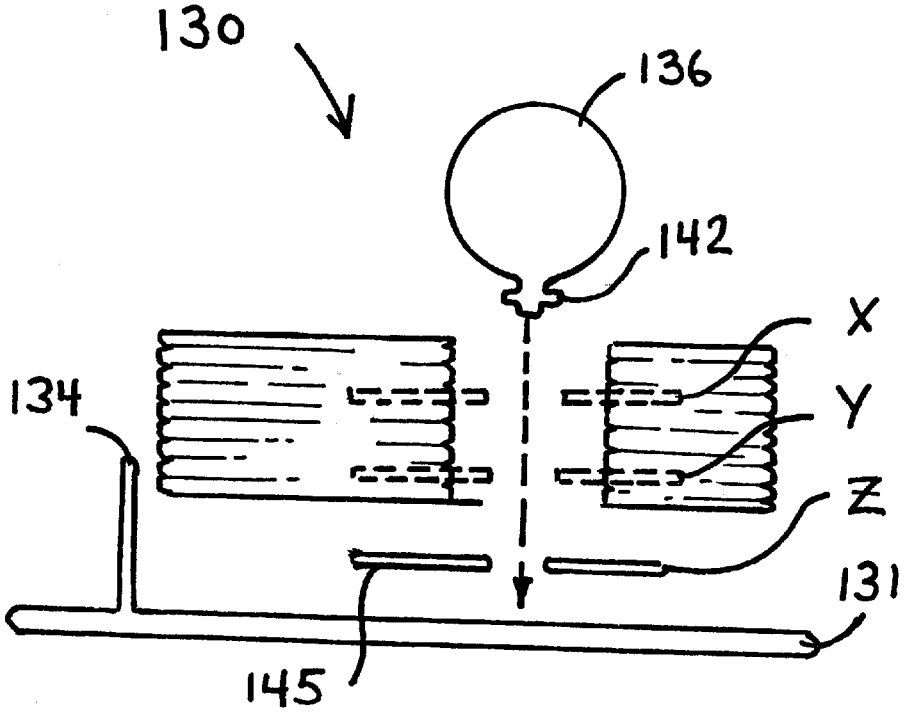
FIG. 16 is the same view as FIG. 15 showing the steps of adjusting the height of the floating eyeballs.

Referring next to FIGS. 15, 16 the user may place the tab 145 at position "Z". He must first lift up the pages 133 as shown in FIG. 16. The tab 145 has floating eyeballs 136, 137 attached to it. Once the tab 145 is in the desired position, "X", "Y", or "Z", the pages 133 are placed over the floating eyeballs. In the preferred embodiment of the calendar 130 as shown, the fasteners 142, 144 allow the user to pull out the floating eyeballs 136, 137, move the tab 145, and re-insert the floating eyeballs down through holes 138, 139 into the tab 145.

Figure 17:
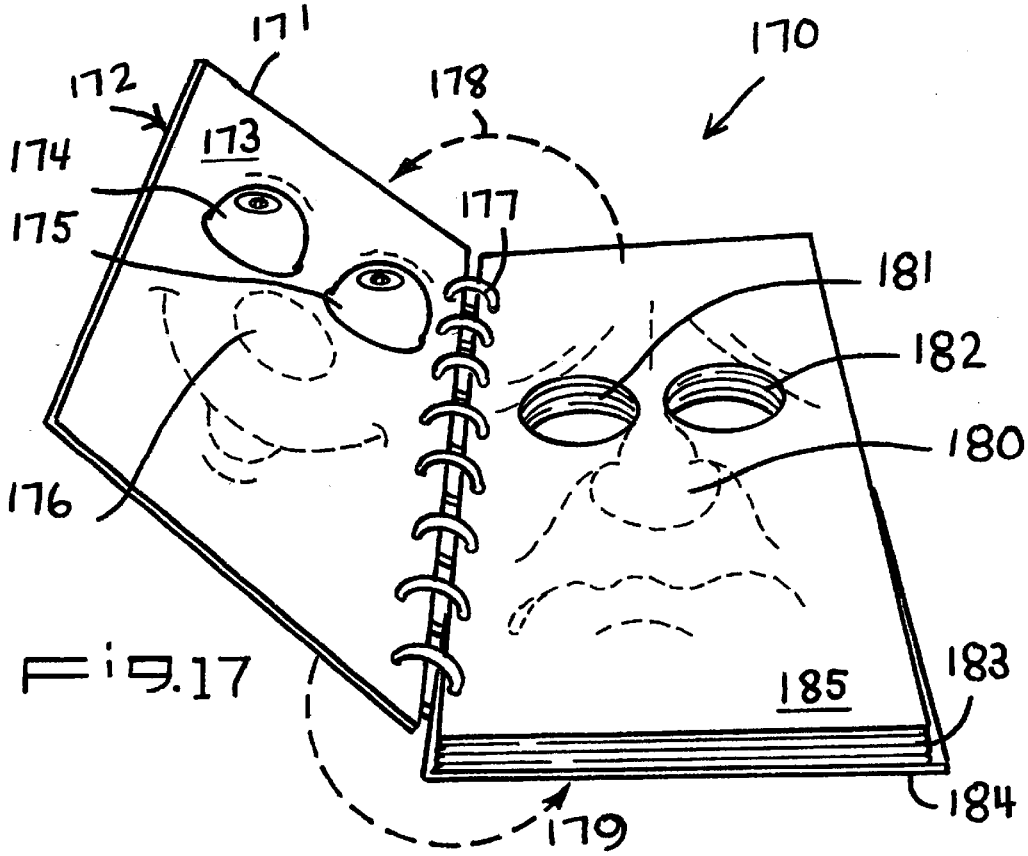
FIG. 17 is a top perspective view of a book embodiment having a spiral binder.
Figure 18:
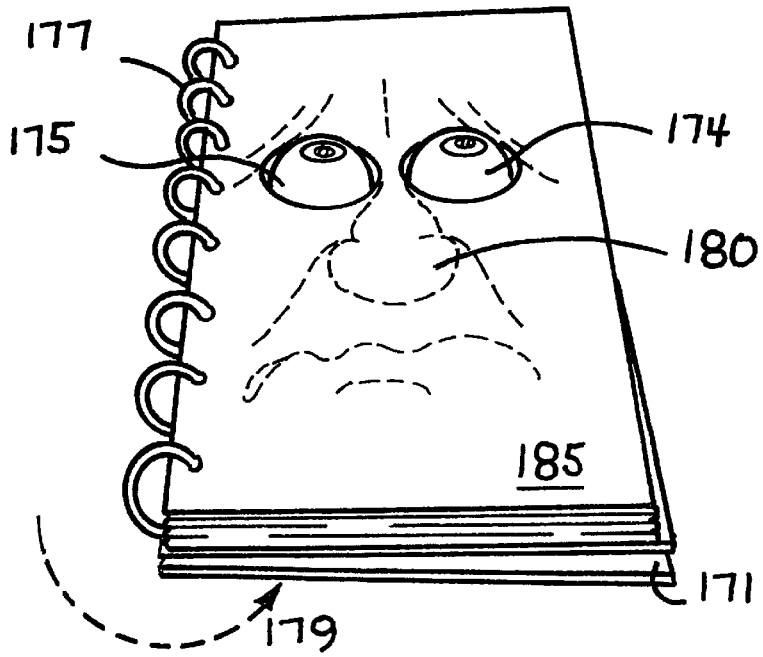
FIG. 18 is the same view as FIG. 17 with the book closed.

Referring next to FIG. 17 a horizontal format book 170 has a spiral binder 177. The front panel 171 has a pair of floating eyeballs 174, 175. The front panel 171 also has a front page 172 preferably having a coordinated design with the floating eyeballs 174, 175, and an inside cover page 173 having the smiley face design 176. The inside pages 183 include second page 185 having the grown design 180. There is also a back panel 184. The inner pages 183 and back panel 184 all have holes 181, 182 which allow the floating eyeballs 174, 175 to pass through with the front panel 171 opened in direction 178. The smiley face design 176 coordinates with the floating eyeballs 174, 175 as shown in FIG. 18. All the inside pages 183 can have a coordinated design on both sides in this embodiment.

Figure 19:
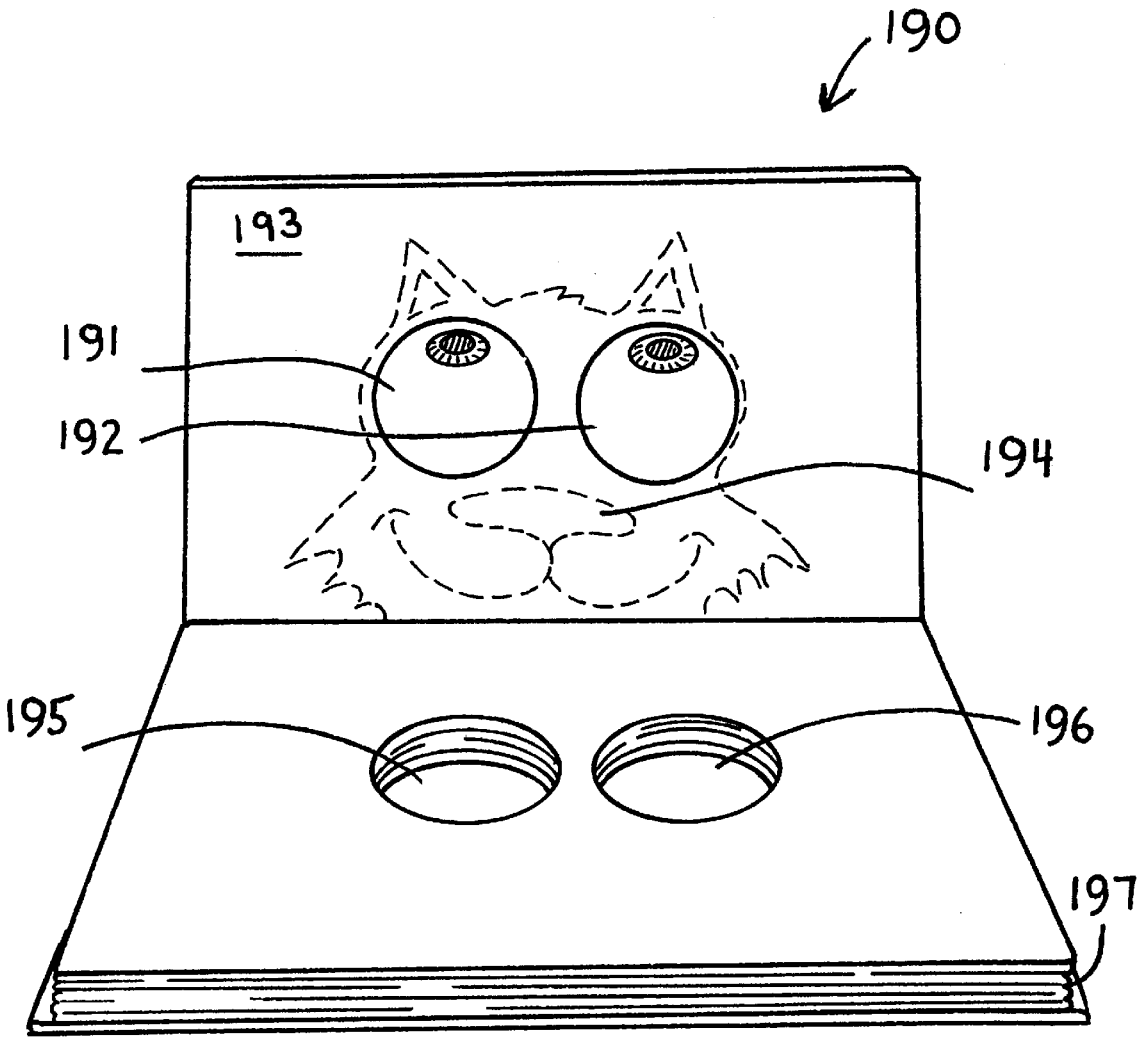
FIG. 19 is a top perspective view of a book embodiment with a vertical format.

Referring next to FIG. 19 a vertical format book 190 is shown. A top panel 193 houses the floating eyeballs 191, 192. The coordinated design 194 is located on the inside cover page. Preferably, another design is on the front cover page (not shown). The inside pages 197 have holes 195, 196. Each inside page, preferably, has a coordinated design on each underside for display with the floating eyeballs 191, 192 as desired.

Yet another alternate embodiment not shown includes a doodle pad identical to the calendar 130 but with the deletion of the alpha-numeric characters 140 and/or the addition of illustrations.

Figure 20:
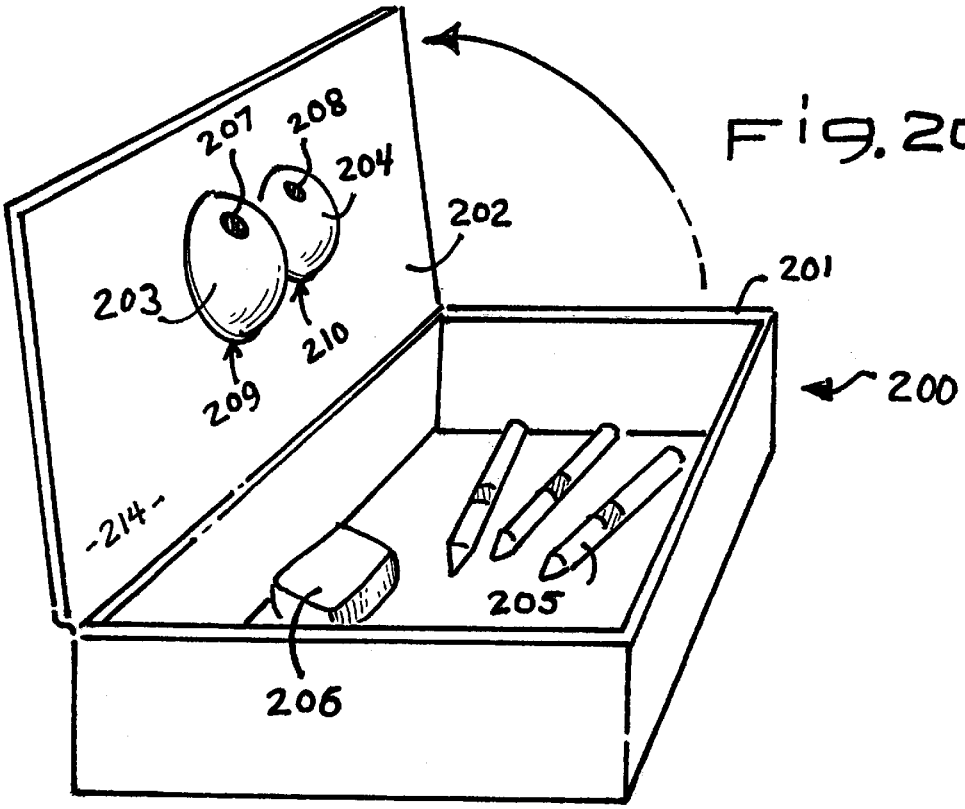
FIG. 20 is a top perspective view of an art box, lid open.
Figure 21:
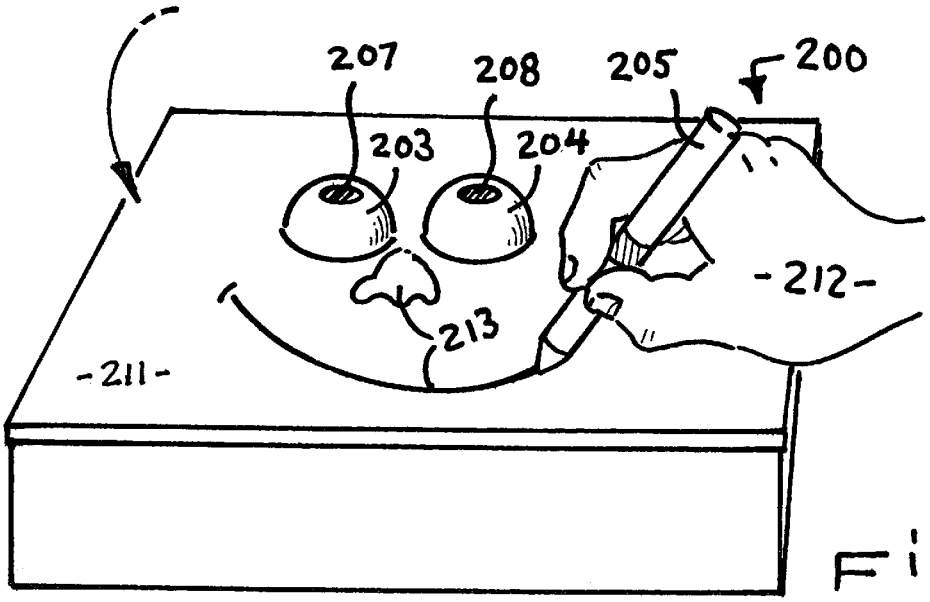
FIG. 21 is a top perspective view of the same art box shown in FIG. 20, lid closed.

Referring next to FIGS. 20,21 the activity box or drawing box 200 has a container portion 201 suitable to hold items including art and crafts supplies. The lid 202 has holes 209, 210 in which are mounted spherical toy balls 203, 204 which in this case are wiggly eyeballs having pupils 207, 208 and internal weights (not shown) which cause the pupils to float up, thereby creating a different look for each angle the lid 202 is held at.

FIG. 21 shows the lid 202 closed. The top surface 211 of the lid 202 is a drawing surface as shown by child 212 using an erasable (wipe off) crayon 205 to draw face 213. The pupils 207,208 are facing up to allow a changing of views of the face 213 as the box 200 is tilted and/or shaken. A second drawing surface and/or pre-printed graphic can be made on inner lid surface 214. Thus, both surfaces of the lid are functional to coordinate with the 3D, moving, bulging spherical toy balls 203,204.

Figure 22:
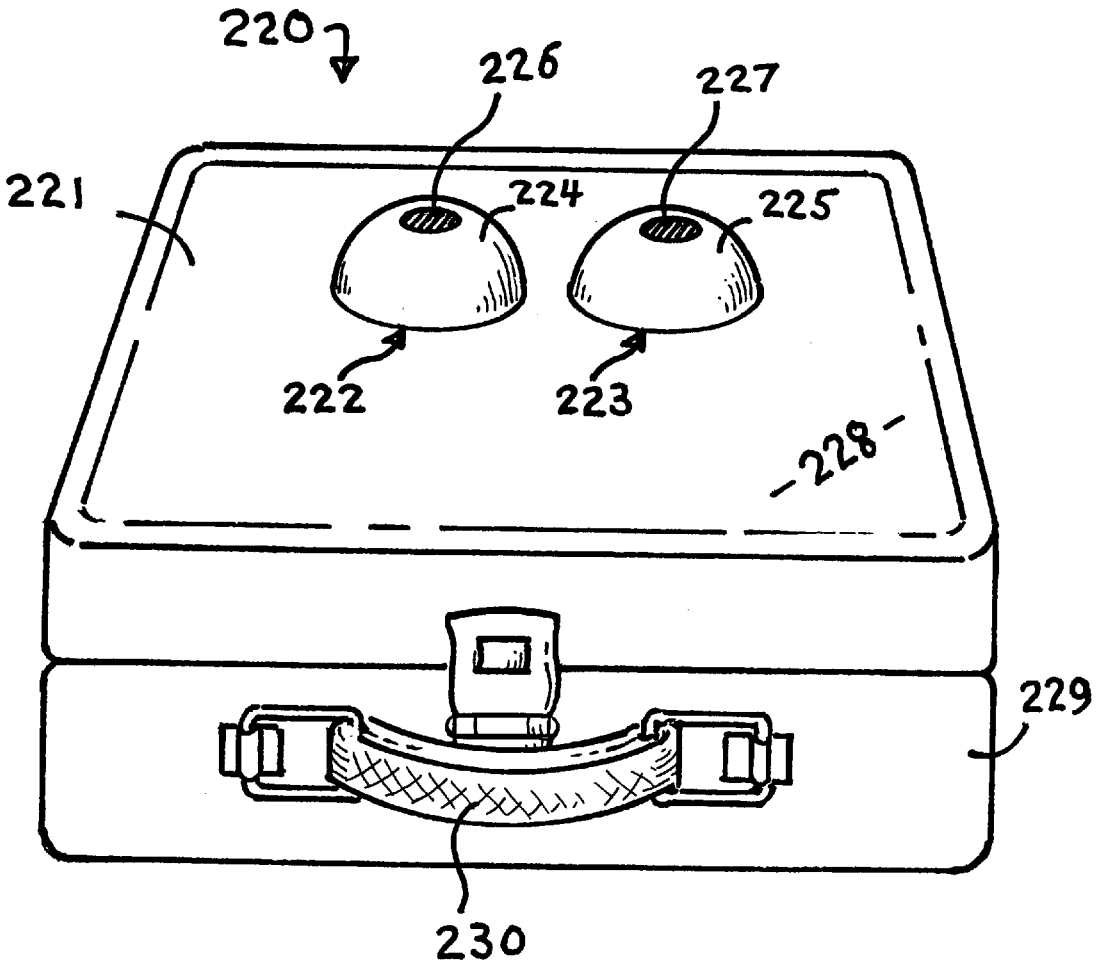
FIG. 22 is a top perspective view of a lunch box, lid closed.

Referring next to FIG. 22 a lunch box 220 has a container portion 229, a handle 230 and a lid 221. Holes 222,223 are used to mount the spherical toy balls 224,225, which in this case are floating eyeballs having a weighted inner sphere to keep the pupils 226,227 facing upward. Coordinated graphics, and/or drawing surface are optional on outer lid surface 228 and the inner lid surface (not shown).

Figure 23:
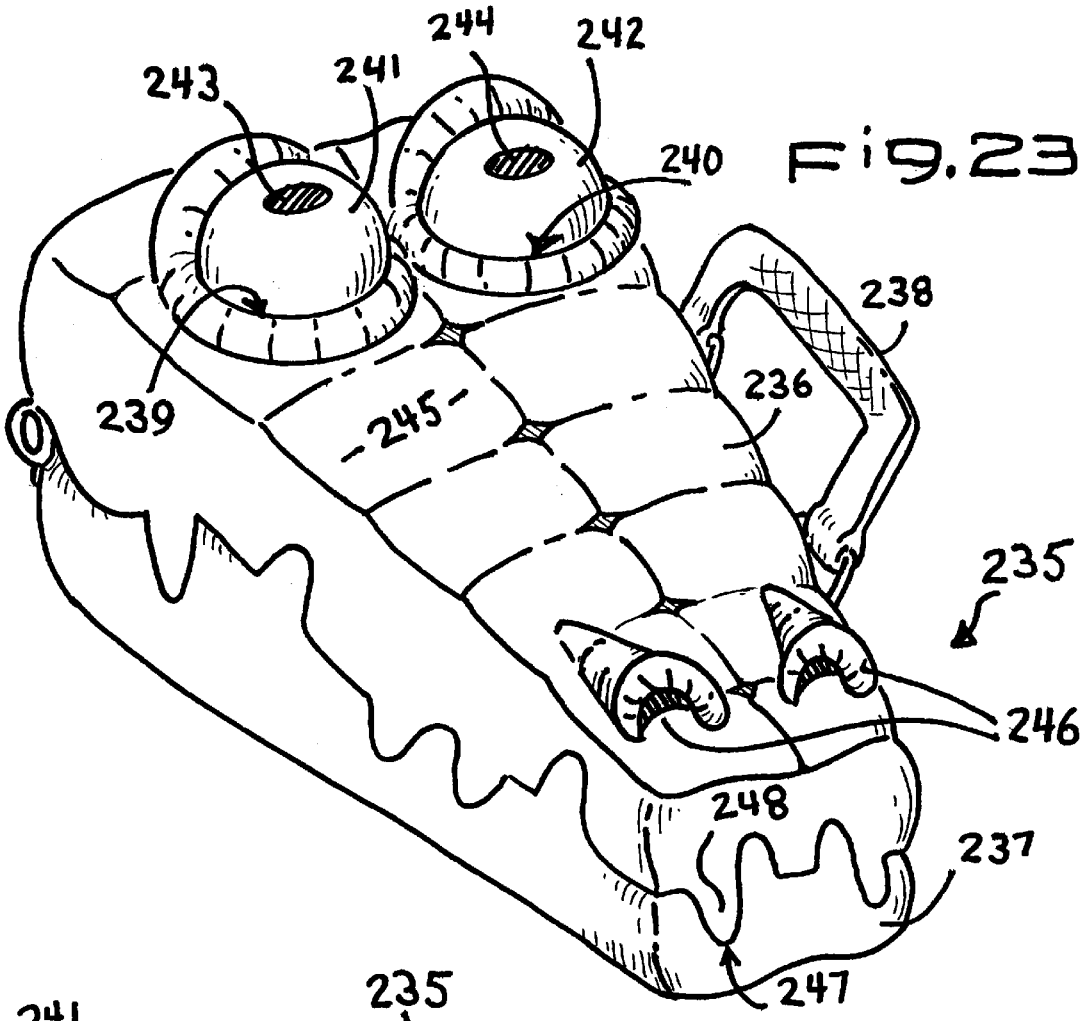
FIG. 23 is a top perspective view of a 3D storage box, lid closed.
Figure 24:
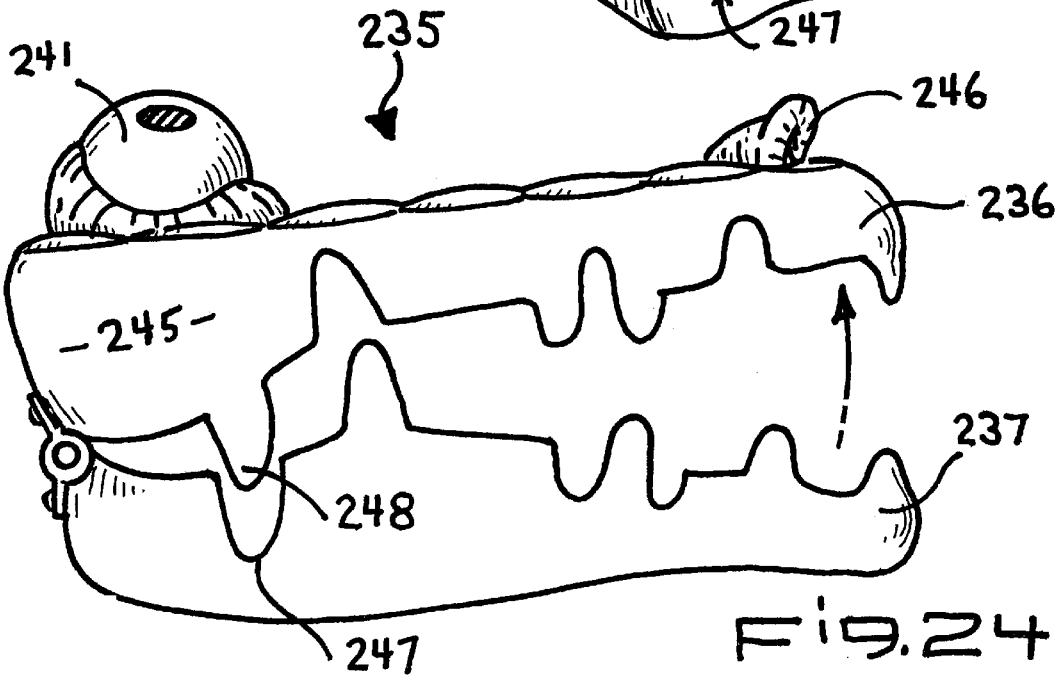
FIG. 24 is a side plan view of the storage box shown in FIG. 23 with lid partially open.
Figure 25:
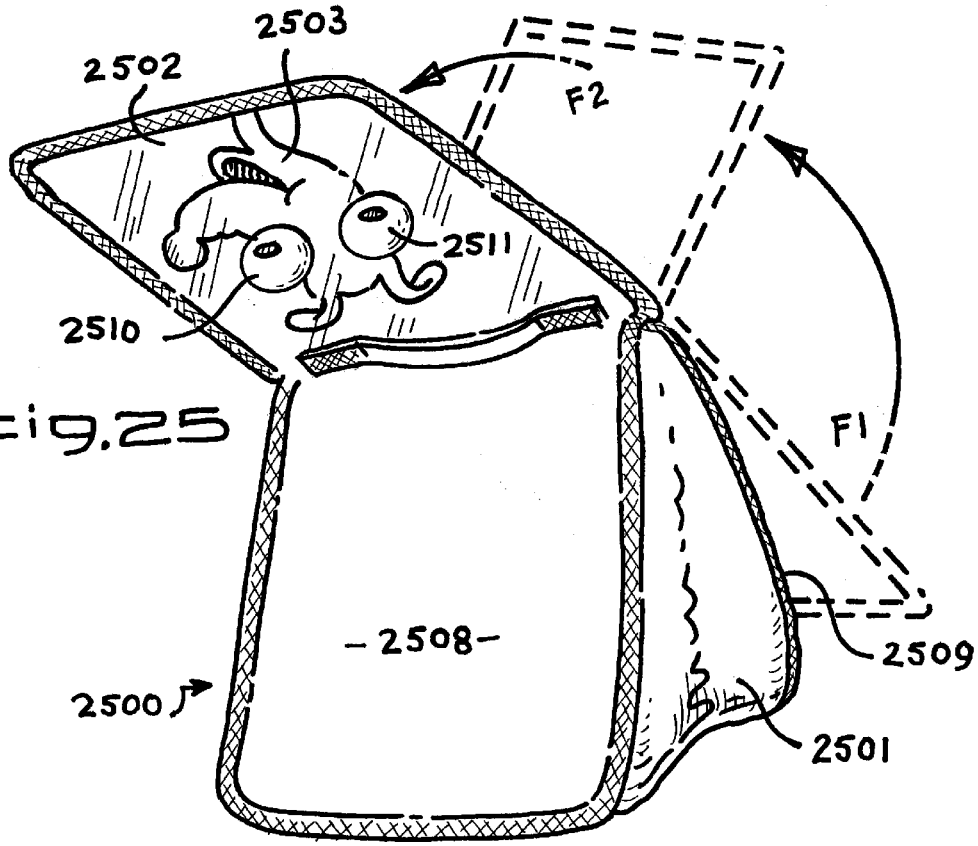
FIG. 25 is a front perspective view of a preferred lunch bag, lid partially open, rotating from front to back.
Figure 26:
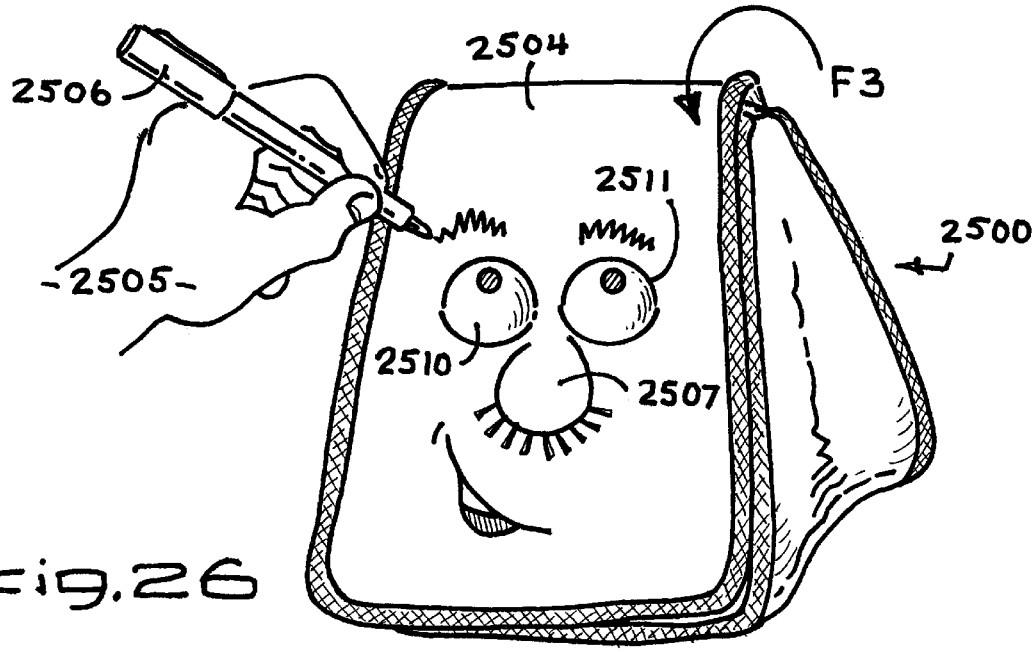
FIG. 26 is a rear perspective view of the lunch bag shown in FIG. 25, with the panel turned over to the interactive surface.

Referring next to FIGS. 23,24 a toy box 235 has a container portion 237 and a lid 236 which has a contoured top surface 245. The top surface 245 also has two holes 239,240 into which spherical toy balls 241,242 are mounted. The spherical toy balls in this case are floating eyeballs having pupils 243,244. The container portion has a handle 238. The top surface includes nostrils 246 which coordinate with teeth 248 and notches 247 as well as the floating eyeballs 241,242 to create an alligator face.

FIG. 24 shows the alligator face toy box 235. The side profile shows the gator, jaws open with teeth 248 and notches 247, a nostril 246 and a contoured top lid surface 245, all coordinated with a floating eyeball 241, the floating eyeball again mounted in a bulging manner from the top and bottom of the lid 236. This toy box concept can be made into animal, creature, human or the like characters, wherein the bulging spherical toy ball combined with the bulging facial features is the key novel feature.

FIGS. 25,26,27,28 show the preferred embodiment, a spherical toy ball lunch bag 2500. An expandable base 2501 has a triangular side profile and a back panel 2509 and a front panel 2508. A hinged panel 2502 may have a preprinted caricature 2503 and on the opposite side an interactive surface which in this case is a dry-erase surface 2504, wherein a child 2505 is drawing a face 2507 using a marker 2506. Once again spherical toy balls (preferable floating eyeballs) 2510,2511 provide the key novel feature of the device, wherein they bulge from both sides of the hinged panel 2502. The arrows show the hinged panel 2502 in the preprinted outward F1, in transition F2, and doodle pad outward F3 positions.

Figure 28:
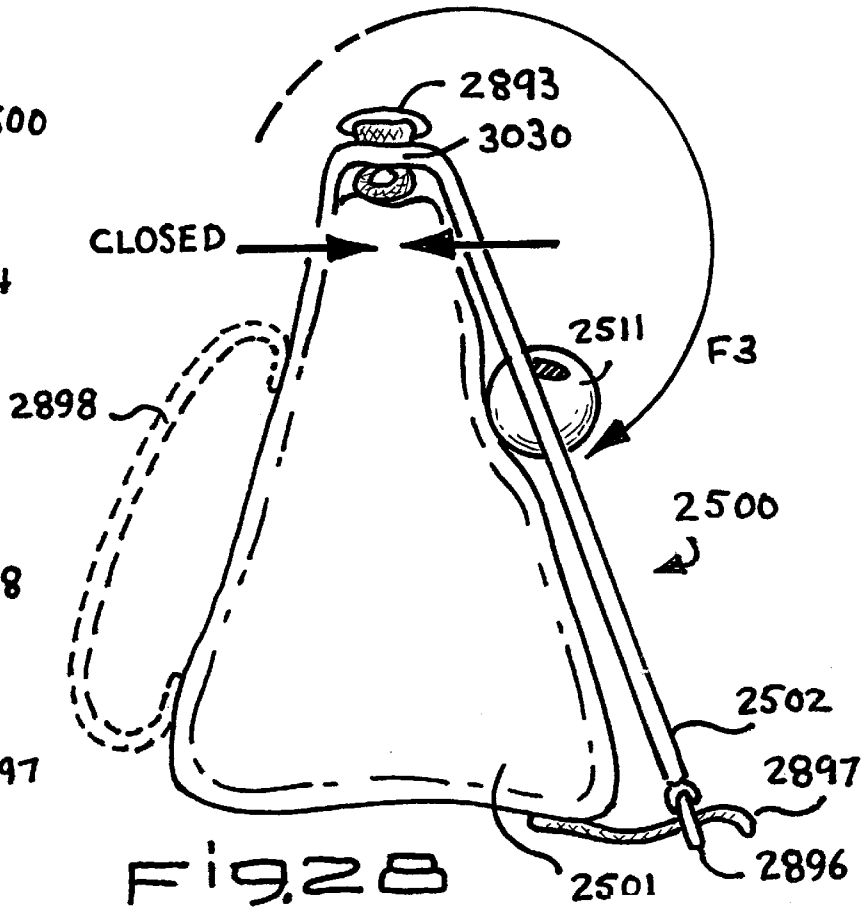
FIG. 28 is a plan view of the lunch bag shown in FIG. 27, bag closed.
Figure 27:
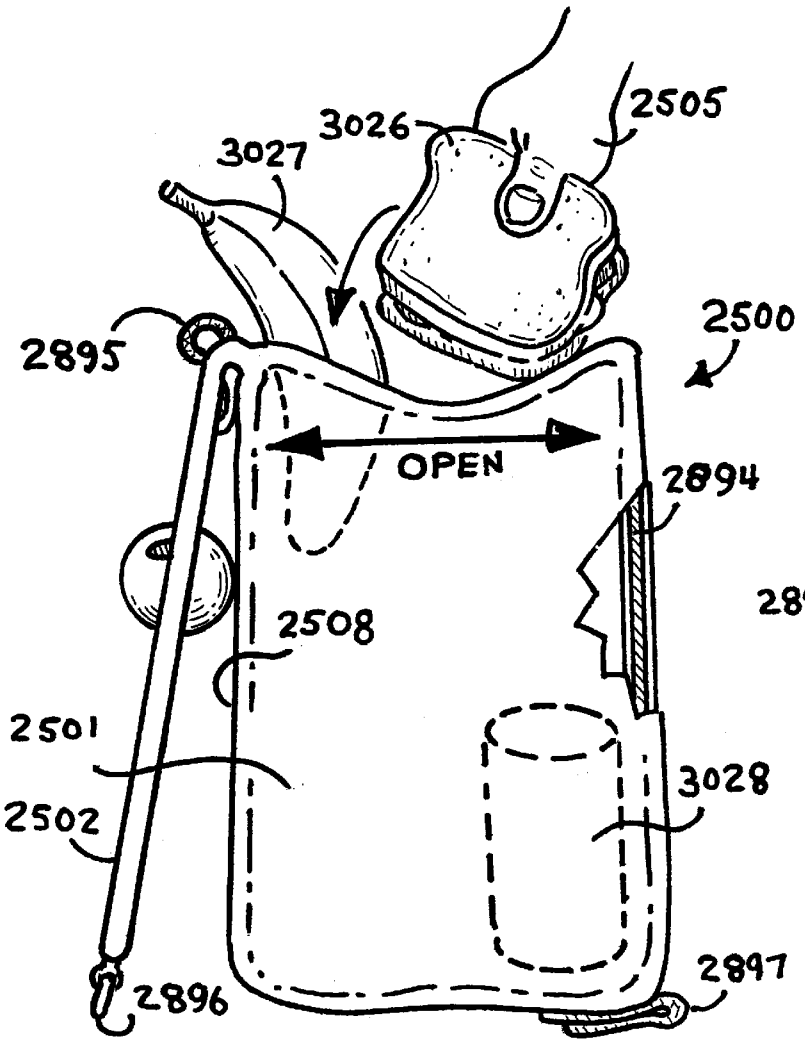
FIG. 27 is a side plan view of the lunch bag shown in FIG. 25, the storage compartment open.

FIGS. 27,28 show the base 2501 in the OPEN and CLOSED positions, wherein the hinged panel 2502 is hinged on the panel 2508 and forms a lid 3030 in the closed position F3. The child 2505 can insert lunch items 3026, 3027,3028 when the base 2501 is in the OPEN position in FIG. 27.

Additional optional features are shown in FIGS. 27,28 including a handle 2893, a drawing utensil holder 2895, a closure means of a hoop and loop strap 2897 with a buckle 2896 (equivalents including snaps and zippers). The insulating is layer 2894 could be Revolutionary Freeze Tech™ Thermo Reflective insulation. The device becomes a backpack with shoulder straps 2898 shown in dotted lines.

Although the present invention has been described with reference to preferred embodiments, numerous modifications and variations can be made and still the result will come within the scope of the invention. No limitation with respect to the specific embodiments disclosed herein is intended or should be inferred.

PARTIAL KEY

1. Left eyeball
2. Right eyeball
3. Motion of embedding left eyeball into panel
4. Motion of embedding right eyeball into panel
5. Left eyehole
6. Right eyehole
7. Panel or book cover
8. Inner pages or panels of a book or card
9. Back cover of book or card
10. Painted or drawn on facial features
11. Painted or drawn on facial features
12. Painted on or drawn facial features
13. Arrow representing the opening or flipping of a front panel or cover of book or card
14. Additional page or panel
15. Left eyehole in additional panel
16. Right eyehole in additional panel
17. Painted or drawn on facial features
18. Painted or drawn on facial features
19. Painted or drawn on facial features
20. Painted or drawn on facial features
21. Painted or drawn on facial features
22. Arrow representing the turning or flipping of inner pages or panels onto an inner previous page or panel
23. Previous inner page or panel
24. Inner Page or panel with eyeholes
25. Inner Page or panel with eyeholes
26. Left eyehole
27. Right eyehole
28. Painted or drawn on facial features
29. Painted or drawn on facial features
30. Painted or drawn on facial features
31. Painted or drawn on facial features
32. Painted or drawn on facial features
33. Painted or drawn on facial features
34. Arrow representing the turning or flipping of the back panel or cover of book or card onto an inner previous page or panel
35. Painted or drawn on facial features
36. Painted or drawn on facial features
37. Painted or drawn on facial features
38. Arrow representing the tilting of the panel in different directions and the automatic upwards rotation of the eyeball affixed to the panel
39. Arrow representing the automatic upwards rotation of the eyeball during slight tilting of the panel above horizontal
40. Arrow representing the automatic upwards rotation of the eyeball during tilting of the panel at an approximately 45 degree angle
41. User's hand holding panel slightly tilted above horizontal
42. User's hand holding panel tilted at approximately 45 degrees
43. Clear plastic outer sphere of right eyeball
44. Right eyeball-decorated inner sphere
45. Clear liquid separating right eyeball-decorated inner sphere and clear outer shell
46. Adhesive or other glue locking system
47. Clear plastic outer sphere of left eyeball
48. Left eyeball-decorated inner sphere
49. Clear liquid separating left eyeball-decorated inner sphere and clear outer shell
50. User's hand holding and shaking panel
51. Dotted lines representing motion of shaking panel
52. Dotted lines representing motion of shaking panel
53. Dotted lines representing motion of shaking panel
54. Dotted lines representing motion of shaking hand
55. Lines representing visual effect of human-like eye movement
56. Lines representing visual effect of human-like eye movement
57. Painted or drawn on facial features
58. Painted or drawn on facial features
59. Painted or drawn on facial features
60. Series of left eyeballs showing pupils rotating
61. Series of right eyeballs showing pupils rotating

62. User drawn eyebrows on blank panel
63. Blank panel
120. Caricature
121. Book Cover
122. Book
130. Calendar
131. Backplate
132. Stand
133. Calendar pages
134, 135. Ledges
136, 137. Floating eyeballs
138, 139. Holes
140. Alpha-numeric characters
141, 143. Legs
142, 144. Fasteners
145. Tab
146, 147. Holes
170. Horizontal format book
171. Front panel
172. Front page
173. Cover page
174, 175. Floating eyeballs
176. Smiley face design
177. Spiral binder
178. Direction
179. Direction
180. Frown design
181, 182. Holes
183. Inside pages
184. Back panel
185. Second page
190. Vertical format book
191, 192. Floating eyeballs
193. Top panel
194. Coordinated design
195, 196. Holes
197. Inside pages
220 Lunch box
229 Container portion
230 Handle
221 Lid
222, 223 Holes
224, 225 Spherical toy balls
226, 227 Pupils
228 Outer lid surface
235 Toy box
237 Container portion
236 Lid
245 Contoured top surface
239, 240 Contoured holes (part of 3D effect)
241, 242 Spherical toy balls
243, 244 Pupils
238 Handle
246 Nostrils
248 Teeth
247 Notches
2500 Spherical toy lunch bag
2501 Expandable base
2509 Back panel
2508 Front panel
2502 Hinged panel
2503 Preprinted caricature
2504 Interactive surface
2505 Child
2507 Face
2506 Marker
2510,2511 Spherical toy balls
3030 Lid
3026,3027,3028 Lunch items
2893 Handle
2894 Insulating layer
2895 Utensil holder
2897 Hoop and loop strap
2896 Buckle
2898 Backpack
"X", "Y", "Z". Positions

We claim:

1. An animated lunch bag comprising:

a flexible storage bag having a front and a rear planar surface adjoined by a foldable pair of sides;

said rear planar surface supporting a closable lid;

said closable lid having a lid planar surface with a hole wherein a spherical toy ball is mounted in the hole in a bulging manner from a front and a back side thereof;

wherein said closable lid folds over a portion of either the front or rear planar surface; and said front and back side of the closable lid each having a coordinated graphic surface, an interactive surface, or a combination of a graphic and an interactive surface, which creates a 3D depiction with the spherical toy ball.

2. The apparatus of claim 1, wherein the closable lid has two spherical toy balls each mounted in a separate hole.

3. The apparatus of claim 2, wherein the spherical toy balls are floating eyeballs.

4. The apparatus of claim 3, wherein the closable lid has a side with a facial character coordinated with the floating eyeballs.

5. The apparatus of claim 4, wherein the closable lid further comprises a drawing utensil holder.

6. The apparatus of claim 1, wherein the flexible storage bag further comprises a handle.

7. The apparatus of claim 1, wherein the flexible storage bag further comprises an insulating layer.

8. An animated storage bag comprising:

a flexible bag means functioning to store contents therein, said bag means having a front and a rear planar surface adjoined by a foldable pair of sides;

said front planar surface supporting a closable lid means functioning to enclose said contents;

said closable lid means having a lid planar surface with a hole, wherein a spherical toy ball is mounted in the hole in a bulging manner from a front and a back side thereof;

said closable lid means functioning to fold over a portion of either the front or rear planar surface; and at least one side of said front and back side of the closable lid means having a coordinated graphic surface, an interactive surface, or a combination of a graphic and an interactive surface, which creates a 3D depiction with the spherical toy ball.

9. An animated storage bag comprising:

a flexible bag means functioning to store contents therein, said bag means having a front and a rear planar surface adjoined by a foldable pair of sides;

said rear planar surface supporting a closable lid means functioning to enclose said contents;

said closable lid means having a hole, wherein a spherical toy ball is mounted therein in a bulging manner from a front and a back side thereof; and at least one side of said front and back side of the rear planar surface having a coordinated graphic surface, an interactive surface, or a combination of a graphic and an interactive surface, which creates a 3D depiction with the spherical toy ball.

10. An animated lunch bag comprising:

a flexible storage bag having a front and a rear planar surface adjoined by a foldable pair of sides;

said front planar surface supporting a closable lid;

said closable lid having a hole wherein a spherical toy ball is mounted therein in a bulging manner from a front and a back side thereof;

said front and back side of the closable lid each having a coordinated graphic surface, an interactive surface, or a combination of a graphic and an interactive surface, which creates a 3D depiction with the spherical toy ball;

wherein the closable lid has two spherical toy balls each mounted in a separate hole;

wherein the spherical toy balls are floating eyeballs;

wherein the closable lid has a side with a facial character coordinated with the floating eyeballs; and wherein the closable lid further comprises a drawing utensil holder.

11. The apparatus of claim 10, wherein the closable lid further comprises a closure strap.

12. An animated storage bag comprising:

a flexible bag means functioning to store contents therein, said bag means having a first and a second planar surface adjoined by a foldable pair of sides;

said first planar surface supporting a closable lid means functioning to enclose said contents;

said closable lid means having a hole, wherein a spherical toy ball is mounted therein in a bulging manner from a front and a back side thereof; and at least one side of said front and back side of the first planar surface having a coordinated graphic surface, an interactive surface, or a combination of a graphic and an interactive surface, which creates a 3D depiction with the spherical toy ball.

13. An animated storage bag comprising:

a flexible bag means functioning to store contents therein, said bag means having a first and a second planar surface adjoined by a foldable pair of sides;

said second planar surface supporting a closable lid means functioning to enclose said contents;

said closable lid means having a hole, wherein a spherical toy ball is mounted therein in a bulging manner from a front and a back side thereof, and at least one side of said front and back side of the second planar surface having a coordinated graphic surface, an interactive surface, or a combination of a graphic and an interactive surface, which creates a 3D depiction with the spherical toy ball.

* * * * *